US006639504B2

(12) United States Patent
Eberl et al.

(10) Patent No.: US 6,639,504 B2
(45) Date of Patent: Oct. 28, 2003

(54) THERMAL SWITCHING DEVICE

(75) Inventors: Karlheinz Eberl, Nürnberg (DE); Udo Stenzel, Bad Bocklet (DE); Klaus Dölling, Münnerstadt (DE)

(73) Assignee: Thermostat-und Schaltgeratebau GmbH & Co. KG, Bad Kissingen (DE)

( * ) Notice: Subject to any disclaimer, the term of this patent is extended or adjusted under 35 U.S.C. 154(b) by 43 days.

(21) Appl. No.: 09/900,671

(22) Filed: Jul. 6, 2001

(65) Prior Publication Data

US 2002/0075122 A1 Jun. 20, 2002

(30) Foreign Application Priority Data

Jul. 8, 2000 (DE) ..... 100 33 354

(51) Int. Cl.[7] ..... H01H 37/76; H01H 37/02

(52) U.S. Cl. ..... 337/401; 337/414; 337/417; 337/148

(58) Field of Search ..... 337/401–417, 337/298, 299, 142, 148; 29/623

(56) References Cited

U.S. PATENT DOCUMENTS

| | | | | | |
|---|---|---|---|---|---|
| 3,629,766 | A | * | 12/1971 | Gould, Jr. | 337/239 |
| 3,820,050 | A | * | 6/1974 | Tyler et al. | 337/408 |
| 4,090,166 | A | * | 5/1978 | Burch | 200/249 |
| 4,109,225 | A | * | 8/1978 | Hollweck | 337/338 |
| 4,295,114 | A | | 10/1981 | Pohl | 337/3 |
| 4,411,061 | A | * | 10/1983 | Clapper et al. | 29/460 |
| 4,472,705 | A | * | 9/1984 | Carlson | 337/299 |
| 4,899,124 | A | * | 2/1990 | Hollweck | 337/299 |
| 5,138,297 | A | * | 8/1992 | Hollweck | 29/622 |
| 5,159,309 | A | | 10/1992 | Bayer | 337/402 |
| 5,612,663 | A | | 3/1997 | Hollweck | 337/407 |
| 5,825,278 | A | * | 10/1998 | Reid et al. | 337/407 |
| 5,898,356 | A | * | 4/1999 | Gascoyne et al. | 337/125 |

FOREIGN PATENT DOCUMENTS

| | | | | |
|---|---|---|---|---|
| AT | 394 637 B | | 10/1991 | H01H/37/76 |
| DE | 29 42 478 C2 | | 4/1981 | H01H/85/08 |
| DE | 224 443 A1 | | 7/1985 | H01H/37/71 |
| DE | 37 35 334 C2 | | 9/1989 | H05B/1/02 |
| GB | 1 479 364 | | 7/1977 | H01H/37/00 |
| JP | 01279532 A | * | 11/1989 | H01H/37/54 |
| JP | 05062575 A | * | 3/1993 | H01H/37/32 |

* cited by examiner

*Primary Examiner*—Anatoly Vortman
(74) *Attorney, Agent, or Firm*—Morgan & Finnegan, LLP

(57) ABSTRACT

The invention relates to a thermally controlled electric switching device 1, especially a temperature fuse or a temperature limiter, with a switching contact device 2 comprising a fixed contact 3 and a motion contact 4, as well as a meltable element 8 containing a meltable material 7, wherein the meltable material 7 supports a transmission element 9 before being activated when a trigger temperature is exceeded and, when the trigger temperature is exceeded, is forced out of its receptacle 6 by the end of the transmission element 9 impinging upon it, wherein a radially protruding, flat melt material screen 19 is arranged on the transmission element 9.

10 Claims, 2 Drawing Sheets

THERMAL SWITCHING DEVICE

The invention relates to a thermally controlled electric switching device, especially a temperature fuse or a temperature limiter, with the additional features of the introductory clause of claim 1.

DE 3735331 C2 discloses a thermally controlled electric switching device in which a switching device comprising a motion contact and fixed contact is arranged on a carrier element. In addition, a meltable element is provided that supports a transmission element before being activated when a trigger temperature is exceeded. When the trigger temperature is exceeded, the material of the meltable element is forced out of its cup-like receptacle at the end of the transmission element.

The solder that escapes during this process can, depending on the installed position of the thermal switching device, affect additional electrical elements of the switching device or other electric components of the device. In particular, the solder beads that form as a result of the escaping solder can impair the thermal switching device and compromise its intended safety function.

To secure the transmission element in its designated position prior to final assembly of the device and to simplify assembly, a ring-shaped collar is provided that enlarges the diameter of the transmission element.

The object of the invention/innovation is to further develop a thermal switching device with the features of the introductory clause of claim 1 in such a way that the risk of electrical interference following activation of the thermal switching device is reduced and, in particular, escaping molten solder is spatially controlled.

This object is solved by the characterizing portion of claim 1. Advantageous enhancements of the invention/innovation result from the subclaims.

It has become evident that, due to the surface tension of the molten solder, an enlargement of the transmission element in the form of a melt material screen advantageously results in the escaping molten solder being uniformly accepted and retained under the screen-like enlargement, as it surrounds the stamp-like end of the transmission element in annular fashion or in the form of individual solder beads, thus remaining beneath the screen provided. Furthermore, because of the melt material screen the prescribed electric air and leakage gap is maintained, even if, as a result of the escaping molten solder, especially the aforementioned molten solder beads, the distance is reduced between electric components, especially between the carrier element for the meltable solder charge, which is filled with material, and the motion contact. This reduction in distance is offset advantageously by the melt material screen.

It is especially advantageous if the melt material screen is arranged on the end of the transmission element facing away from the melt element, so that the transmission element exhibits the overall shape of a mushroom, with a stamp-like segment at its lower end and the screen at its top end.

Advantageously, the diameter of the melt material screen is approximately twice that of the stamp-like segment of the transmission element that dips into the solder. The outer edge of the melt material screen is pulled down in the direction of the molten solder intake, so that a hollow space is formed inside the screen, which can, in an especially advantageous manner, be used to take up molten solder.

In general, the volume of the region beneath the melt material screen and the volume of the expelled molten solder should correspond. The volume beneath the under side of the screen should be greater than the volume of the expelled molten solder, so that the portion of the screen descending onto the molten solder does not press the solder outward in a radial manner, thereby eliminating the beneficial effect of the screen.

The transmission element and the melt material screen, which is advantageously arranged on it in one piece, are both made of an electrically non-conductive material, so as to advantageously lengthen the air gap and guarantee electrical insulation between the motion contact and the molten solder.

A projection supporting the motion contact is arranged on the upper side of the melt material screen; said projection can lock into a recess in the unattached end of the motion contact. Thus, the insertion of the transmission element into the prepared switch can be easily achieved, in that the lower end is inserted into the cup containing the melt solder charge and the motion contact spring element is snapped over the projection. This is a relatively simple assembly procedure, which can also be performed by automated means.

The projection is advantageously cone-shaped. The melt material screen can also be held on the stamp-like segment of the transmission element in a displaceable manner, so that the screen-like transmission element can descend onto the escaping molten solder and encapsulate it. When the transmission element is in its sunken position, the outer edge of the melt material screen should protrude radially above the displaced molten solder material or the molten solder material should be at least partially enclosed beneath the screen-like enlargement.

Advantageously, the undercut beneath the melt material screen is shaped in such a way that fluid molten material running up the stamp-like segment is diverted in its direction of flow after it has entered the undercut. This diversion behavior is particularly important when, in older switching devices, the switch contacts adhere to one another or are slightly soldered together and, when the contacts are separated, the stamp or the transmission element suddenly sinks into the molten material and rapidly forces it upward. The diversion prevents the molten material from spraying outward in radial fashion and adversely affecting electrically sensitive surrounding areas.

Claims 14 and 15 describe the especially advantageous uses of the transmission element of a thermal switching device as an elongation element of electrical air and leakage gaps in the switching device, or as a receptacle and screening element for displaced molten solder.

The invention/innovation is depicted in the drawings on the basis of an advantageous sample execution.

Figure 1:
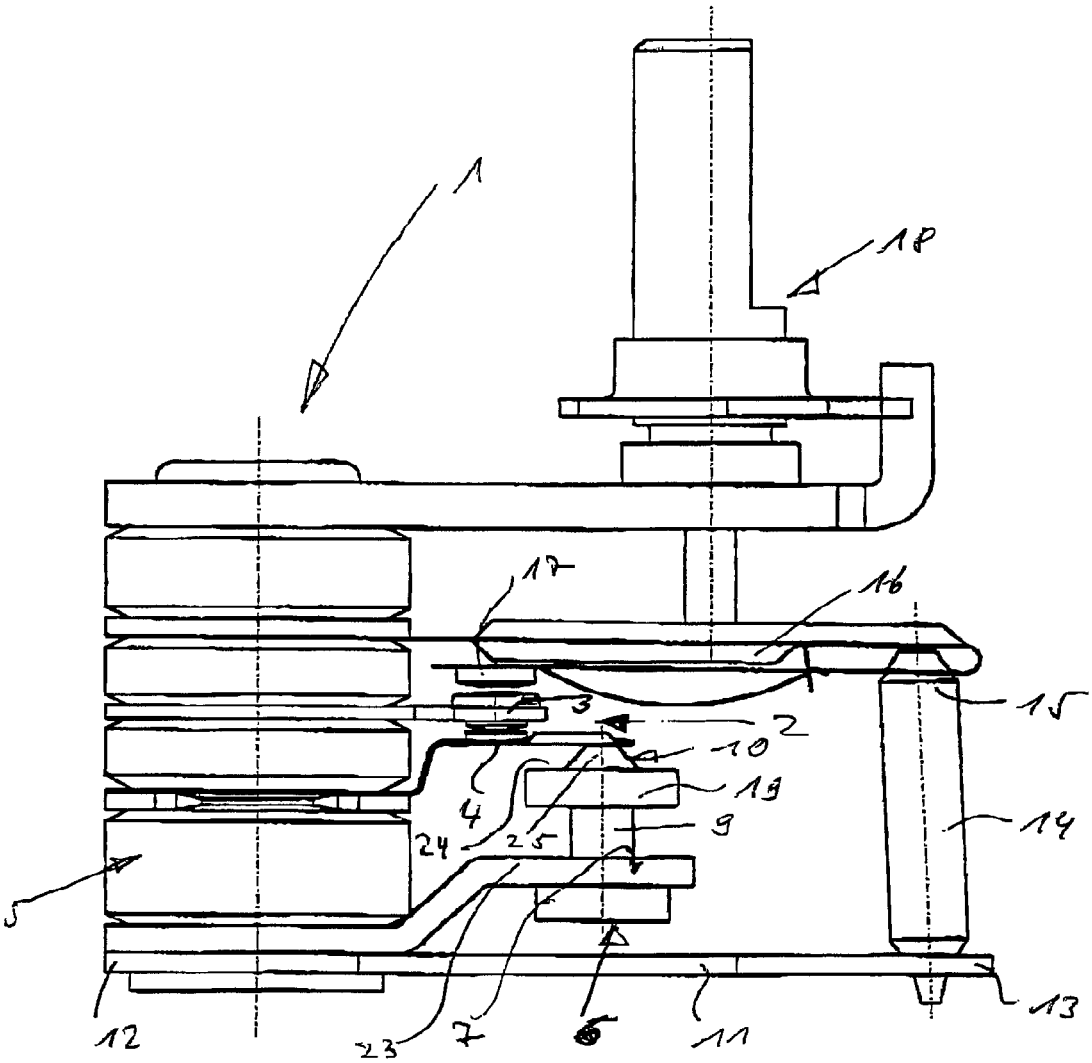
FIG. 1 depicts a side view of a thermal switching device with a closed contact path.

The thermally controlled electric switching device 1 depicted in FIG. 1 features a switch contact mechanism 2 comprising a fixed contact 3 and a motion contact 4. The fixed contact 3 and the motion contact 4 are arranged on a columnar fastening device 5. A melt element 8 containing a meltable material 7 is arranged in a receptacle 6, which is also attached to the fastening device 5 This melt element 8 supports a first end of a transmission element 9, the other end 10 of which holds the motion contact 4 in a locked position with the fixed contact 3.

The switching device 1 also comprises a bimetal element 11, the fixed end 12 of which is also arranged on the columnar fastening device 5, and the pivoting end 13 of which actuates a transmission pin 14. The end 15 of said pin facing away from the bimetal element 11 impinges on a switching spring 16, which carries another motion contact 17 that interacts with the fixed contact 3. As this occurs, the fixed contact 3 acts as a two-sided double contact.

In its central region, the switching spring 16 interacts with a revolving adjustment device 18 to adjust the switching point.

Figure 2:
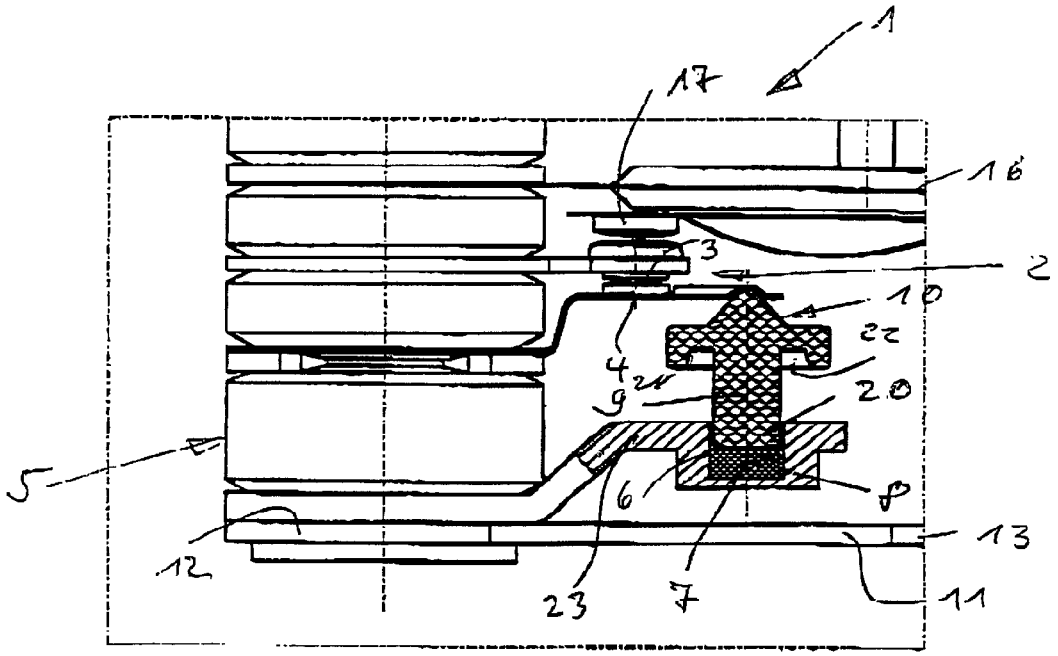
FIG. 2 depicts a partial figure according to FIG. 1, partially in cross-section, prior to activation of the meltable material.

On the end 10 of the transmission element 9 facing away from the melt element 8 is arranged a radially protruding, flat melt material screen 19 which, in terms of its dimensions, possesses approximately twice the diameter of the stamp-like segment 20 of the transmission element 9 that dips into the meltable material. As is particularly evident in FIGS. 2 and 3, the outer edge 21 of the melt material screen 19 is pulled downward, mushroom-like, in the direction of the melt element 8, creating an annular undercut 22 within the melt material screen 19 that encompasses the stamp-like segment 20 of the transmission element 9, which dips into the meltable material 7, and is suitable for partial acceptance of escaping molten material 7. When the transmission element 9 is in its sunken position, as depicted in FIG. 3, the volume of the space between the lower surface of the melt material screen 19 and the upper surface of a carrier 23 containing the receptacle 6 for the meltable material 7 is greater than the volume of the displaced molten material 7 surrounding, either in the form of solder beads or in annular fashion, the segment 20 of the transmission element 9 that dips into the receptacle 6.

The transmission element 9 and the melt material screen 19, which is arranged on it in one piece, are both made of an electrically non-conductive material. A cone-like projection 25 supporting the motion contact 4 is molded onto the upper surface 24 of the melt material screen 19 facing away from the melt element 8, which projection locks into a recess in the motion contact 4, so that the transmission element 9 is locked between the melt element 8 and the motion contact 4 by the elastic force of the motion contact 4.

Figure 3:
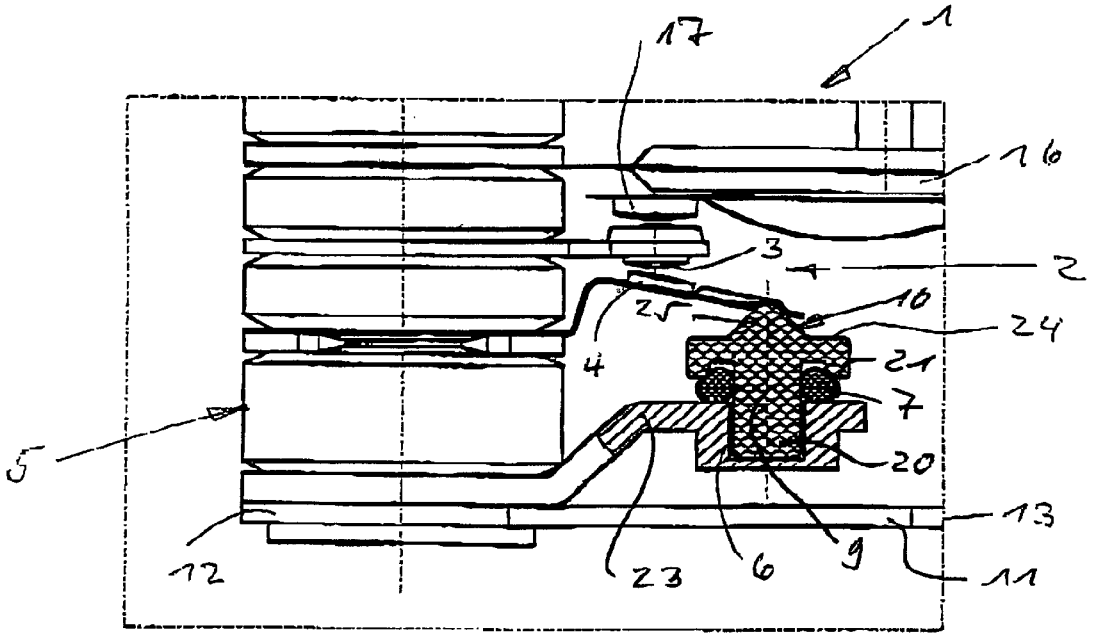
FIG. 3 depicts a partial figure according to FIG. 2, following activation of the meltable material.

It is clearly evident in FIG. 3 that when the transmission element 9 is in its sunken position, the outer edge 21 of the melt material screen 19 protrudes radially above the displaced meltable material 7, so that when the transmission element 9 is in its sunken position, the displaced meltable material 7 is at least partially enclosed beneath the melt material screen 19.

In the sample execution depicted, the transmission element 9, the melt material screen 19 arranged on it, and the cone-like projection 25 are formed as rotationally symmetrical components. However, it is also possible to provide other shapes, such as polygonal, rectangular, or square cross-sectional shapes, if this appears to be advantageous based on the structural circumstances of the switching device 1.

| REFERENCE NUMBERS | |
|---|---|
| 1 | Switching device |
| 2 | Switching contact device |
| 3 | Fixed contact |
| 4 | Motion contact |
| 5 | Fastening device |
| 6 | Receptacle |
| 7 | Meltable material |
| 8 | Melt element |
| 9 | Transmission element |
| 10 | End |
| 11 | Bimetal element |
| 12 | Fixed end |
| 13 | Pivoting end |
| 14 | Transmission pin |
| 15 | End |
| 16 | Switching spring |
| 17 | Motion contact |
| 18 | Adjustment device |
| 19 | Melt material screen |
| 20 | Stamp-like segment |
| 21 | Outer edge |
| 22 | Undercut |

-continued

| REFERENCE NUMBERS | |
|---|---|
| 23 | Upper surface |
| 24 | Projection |

What is claimed is:

1. A thermally controlled electric switching device (1), especially a temperature fuse or a temperature limiter, with a switching contact device (2) comprising a fixed contact (3) and a motion contact (4), as well as a meltable element (8) containing a meltable material (7), wherein the meltable material (7) supports a transmission element (9) before being activated when a trigger temperature is exceeded and, when the trigger temperature is exceeded, is forced out of its receptacle (6) by the end of the transmission element (9) impinging upon it, wherein a radially protruding, flat meltable material screen (19) is arranged on the transmission element (9), the outer edge (21) of the meltable material screen (19) is pulled downward in the direction of the meltable element (8) to form an undercut (22), the undercut (22) beneath the meltable material screen (19) has a rounded cross-section and is shaped in such a way so that the flow direction of the fluid meltable material (7) running up a stamp-like segment (20) of the transmission element (9) is diverted after it has entered the undercut (22).

2. The switching device according to claim 1, wherein the meltable material screen (19) is arranged on the end (10) of the transmission element (9) facing away from the meltable element (8).

3. The switching device according to claim 1, wherein the diameter of the meltable material screen (19) is approximately twice that of the stamp-like segment (20) of the transmission element (9) that dips into the meltable material (7).

4. The switching device according to claim 2, wherein when the transmission element (9) is in its sunken position, the volume of the space between the lower surface of the melt material screen (19) and the upper surface of a carrier (23) containing the receptacle (6) is greater than the volume of the displaced meltable material (7).

5. The switching device according to claim 1, wherein the transmission element (9) and the melt material screen (19) arranged on it in one piece are both made of an electrically non-conductive material.

6. The switching device according to claim 1, wherein a projection (25) supporting the motion contact (4) is arranged on the upper surface (24) of the meltable material screen (19).

7. The switching device according to claim 6, wherein the projection (25) is cone-shaped.

8. The switching device according to claim 3, wherein the melt material screen (19) is held on the stamp-like segment (20) of the transmission element (9) in a displacable manner.

9. The switching device according to claim 1, wherein when the transmission element (9) is in its sunken position, the outer edge (21) of the melt material screen (19) protrudes radially above the displaced meltable material (7).

10. The switching device according to claim 4, wherein when the transmission element (9) is in its sunken position, the displaced meltable material (7) is at least partially enclosed beneath the melt material screen (19).

* * * * *